US012808212B2

(12) United States Patent
Carroll et al.

(10) Patent No.: US 12,808,212 B2
(45) Date of Patent: Nov. 24, 2026

(54) BUILDERS PROFILING TOOL

(71) Applicant: DION CARROLL PTY LTD, Thirroul (AU)

(72) Inventors: Dion Carroll, Thirroul (AU); Rebecca Dickinson, Thirroul (AU)

(73) Assignee: DION CARROLL PTY LTD, Thirroul (AU)

( * ) Notice: Subject to any disclaimer, the term of this patent is extended or adjusted under 35 U.S.C. 154(b) by 343 days.

(21) Appl. No.: 18/259,582

(22) PCT Filed: Dec. 23, 2021

(86) PCT No.: PCT/AU2021/051552

§ 371 (c)(1),
(2) Date: Jun. 27, 2023

(87) PCT Pub. No.: WO2022/140819

PCT Pub. Date: Jul. 7, 2022

(65) Prior Publication Data

US 2024/0052654 A1 Feb. 15, 2024

(30) Foreign Application Priority Data

Jan. 4, 2021 (AU) ..... 2021900007

(51) Int. Cl.
*E04G 21/18* (2006.01)

(52) U.S. Cl.
CPC ..... *E04G 21/1833* (2013.01); *E04G 21/1825* (2013.01)

(58) Field of Classification Search
CPC ..... E04G 21/1833; E04G 21/1825
(Continued)

(56) References Cited

U.S. PATENT DOCUMENTS 6,708,964 B1 * 3/2004 Dedrick ..... B23K 37/04 269/45
2011/0277330 A1 * 11/2011 Dumas ..... E04G 1/04 33/301

(Continued)

FOREIGN PATENT DOCUMENTS

DE 2420746 A1 11/1975
DE 20304837 U1 7/2003

(Continued)

OTHER PUBLICATIONS

International Search Report for International Application No. PCT/AU2021/051552 mailed Feb. 7, 2022.

(Continued)

*Primary Examiner* — Laura Martin
(74) *Attorney, Agent, or Firm* — Perilla Knox & Hildebrandt LLP; Kenneth A. Knox

(57) ABSTRACT

A corner block for supporting a builder's line mounted between posts is described, the corner block comprising a body for receiving the builder's line in use; a pair of gripping members, each gripping member having a gripping face engageable with surfaces of one of the posts in use; and a magnet mounted in the body so as to be associated with at least one of the pair of gripping faces, wherein the magnet has a magnetic force sufficient to attract it to the material of the post to which the gripping faces are applied in use.

20 Claims, 10 Drawing Sheets

(58) Field of Classification Search
USPC ..... 33/403
See application file for complete search history.

(56) References Cited

U.S. PATENT DOCUMENTS

| | | | | |
|---|---|---|---|---|
| 2016/0222684 | A1* | 8/2016 | Titcomb | E04G 17/001 |
| 2019/0106892 | A1* | 4/2019 | Davis | E04G 21/1841 |

FOREIGN PATENT DOCUMENTS

| | | | | |
|---|---|---|---|---|
| EP | 0837200 | A1 * | 4/1998 | E04G 21/1808 |
| GB | 2226592 | A * | 7/1990 | E04G 21/1808 |
| WO | WO-2015024041 | A1 * | 2/2015 | E04G 21/1841 |

OTHER PUBLICATIONS

Written Opinion for International Application No. PCT/AU2021/051552 mailed Feb. 7, 2022.
BT Large Corner Line Holder, Diamond Way Australia Pty Ltd [retrieved from internet on Jun. 27, 2023] <URL: https://web.archive.org/web/20200312040828/https://diamondway.com.au/bt-large-corner-line-holder/ published on Mar. 12, 2020 as per Wayback Machine >.
Examination Report for AU Patent Application No. 2021414767 mailed Dec. 7, 2022.
Notice of Acceptance for AU Patent Application No. 2021414767 mailed Jan. 17, 2023.

* cited by examiner

BUILDERS PROFILING TOOL

CROSS-REFERENCE TO RELATED APPLICATIONS

This application is a national phase application under 35 U.S.C. § 371 of International Application No. PCT/AU2021/051552 filed Dec. 23, 2021 entitled "BUILDERS PROFILING TOOL," which claims the benefit of and priority to Australian Patent Application No. 2021900007 filed Jan. 4, 2021, the contents of both of which being incorporated by reference in their entireties herein.

TECHNICAL FIELD

The present invention relates to a profiling tool used during construction to assist in ensuring that structures are truly horizontal and or vertical.

BACKGROUND

When building walls and other structures, it can be important that surfaces are level (horizontal) and that upright structures are at 90 degrees to level (vertical). Truly horizontal and vertical structures are more aesthetically pleasing, but more importantly from an engineering perspective, these structures are often stronger and therefore safer than structures that deviate from square.

Tradespersons have a number of different tools that they can use to make sure the profiles of the structures that they build are level. For example, a spirit level making use of a small air bubble in a column of liquid can be used to accurately level a surface (to horizontal) by making sure that the bubble sits in the middle of the column of liquid. The tradesperson can use the spirit level during the building process to check and correct the profile their work.

Whilst a spirit level is useful for checking and correction, it can also be useful to have in place a constant marker that delineates what is level during the build. For this purpose, a piece of string or wire stretched between two points can be used to give a constant visual indicator to a builder. The string can be set to truly horizontal or vertical and then the item being constructed can be built with reference to that line. The string (sometimes referred to as Brickies gauge line, Bricklayer's line or Builder's line) can provide a visual indicator during e.g. vertical brick laying of walls, allowing the brick layer tradesperson to correct any movement in the brick line profiles as he/she builds.

Rather than being tied to a post or other structure, the string of the builder's line can be held taut between two corner blocks mounted at spaced apart locations.

Corner blocks can provide a convenient means of securely attaching the string at each end and allows the string to be movable with the corner block. Each corner block can be mounted on a post at the required level for the building process.

When laying bricks, for example, the builder's line might be required at the upper level of the next layer of bricks. To hold the string in place, the string is wrapped around a first corner block including through notches in the block which receive the string and hold it in place relative to the block body. The string can then be pulled over to the other of the corner blocks where it is similarly wrapped around the block's body to hold it in place.

Corner blocks are typically held in place on posts by friction forces imparted by the tight string between them. It is important that the corner blocks do not move in use.

If the corner block moves too much, the string will slacken and the corner blocks will no longer be held tightly against the surfaces of the post. If the corner block is not held tightly it will fall, taking the string with it to the ground. This is inconvenient since the whole arrangement must then be reset. If one of the corner blocks moves along the post only slightly, the moved corner block might stay on the post but the string will no longer be level. If the string is moved from level, the builder might not notice since slight deviations are difficult to detect by the human eye.

Unfortunately, on a building site, there are often people movements and equipment's that touch the string and or the corner block and dislodge the arrangement.

Accordingly, there exists a need for an improved builders profiling tool, or a tool that might provide a useful alternative to the profiling tools already available.

BRIEF SUMMARY

A corner block for supporting builder's line mounted between posts, the corner block comprising a body defining notches for receiving the builder's line in use; a pair of gripping members, each gripping member having a gripping face engageable with surfaces of one of the posts in use; and a magnet mounted in the body so as to be associated with at least one of the pair of gripping faces, wherein the magnet has a magnetic force sufficient to attract it to the material of the post to which the gripping faces are applied in use.

By attaching to the post using the magnet, the corner block may be considerably more stable than corner blocks held in place simply by the force of tightened string.

The risk that the corner block can be moved or dislodged relative to the post is reduced since the magnet provides a force in addition to the force provided by the taut string line. For corner blocks which are frequently dislodged due to their location on-site being in a heavy traffic area, the strength of the magnet can be increased to provide greater stability to that problematic corner block. Furthermore, when the builder wishes to move the line from one level to another level, e.g. when a layer of bricks has been laid and the next layer is about to be prepared, the builder may be able to more readily move the magnetic corner block. Rather than shifting the corner block along the post by applying force against the friction forces, and hoping that the string remains taut during the move, the builder can simply slide the corner block along the post while the magnetic forces are retained. The movement of the corner block may be, in some embodiments, more straightforward and convenient which represents a time saving (and time is money on a construction site).

Furthermore, when working solo installing corner blocks can be difficult because typically one person must hold the first corner block into place while the second corner block is installed under tension. By attaching to the post using a magnet, a person can install the string around the corner block by themselves which allows for increased independence while other tradesmen are attending to their own business.

An additional safety feature provided by the corner block of some embodiments of the present disclosure is that even if the string line between the installed block is cut purposely or accidentally, the corner block(s) will not fall to the ground since it is held in place by magnetic forces. From a safety perspective therefore, the corner block may reduce the risk of the block falling from a height and harming people below.

Prior to undertaking building work, a construction site can be surveyed and then the profiles can be set. Where e.g. a building with four brick walls will be built, a post can be located in each of the proposed four corners of the building. The posts can be secured in place by footings so that they are not movable. Where an internal or external brick wall exists the posts can be a bricklayers profile i.e. a square cross-section steel temporary post/straight edge. The bricklayer's profile can be used to attach the corner block to set the gauges for brickwork/blockwork height. The posts can be made from metal, so they are strong and weatherproof.

The posts are typically of square cross-section, although other shaped cross-sections of posts could be employed. Once in position, pairs of post can be used for suspending the builder's line. A builder's line can be suspended between each pair of post. Alternatively, a single building line can be wrapped around three or all four of the posts forming a partial square or a square respectively. The corner block can support any part of the builder's line including the free ends or a middle part of the line if the line is extending onward to another post.

In an embodiment the corner block is lightweight. The corner block is optionally made of a material that causes it to be strong and crack resistant. The corner block can be formed from a strong plastic material. The corner block can be made from rubberized plastic. The corner block can be made from rubber such as polyurethane. The corner block can be made from wood. The corner block can be hollow to reduce the amount of material used to form it. The dimensions of the corner block are of the order of centimeters, the block can be handled by a person using one hand.

In an embodiment, the body of the corner block comprises two intersecting substantially flat pieces of material forming a cross. Two arms of the cross can form the gripping members of the body of the block. The cross can be reinforced by one or more fins. In an embodiment, the cross is reinforced by a first reinforcing outer fin which forms an outer surface of the corner block body. An intermediate reinforcing fin can be provided along the axis of the body. A second reinforcing outer fin can be provided to form the opposing outer surface of the corner block body. For additional reinforcement, any one of the reinforcing fins can comprise more than one layer with a space therebetween, such as two reinforcing fins located next to one another.

In another embodiment, the body of the corner block comprises a substantially L-shaped molding. Each arm of the L-shaped body can from the gripping member of the body of the block.

The gripping members can be spaced apart from one another at an angle that substantially matches the shape of the post to which it will be applied. Where the post has a square cross section, the gripping members can be spaced at 90 degrees. Where the gripping members are spaced at 90 degrees, the corner block has an L-shaped body. The gripping members can be brought towards the post and then the gripping faces are applied onto the post surfaces. If the post has a triangular cross-section, the gripping members can be spaced from one another by 60 degrees. Any shape of post could be accommodated; however, the correct corner block would have to be selected for the corresponding shaped post. For the purposes of the present disclosure an L-shaped corner block is described and illustrated for convenience. The builder might have various types of corner blocks available to him/her and they would select the most appropriate one according to the post provided.

The gripping faces engage with two surfaces of the post. The gripping faces are pressed onto the surfaces of the post. Where a post has four sides arranged in the order a, b, c and d, the gripping faces can engage with surfaces a and b. The pair of gripping faces can comprise a first gripping face and a second gripping face angled from the first gripping face by e.g. 90 degrees. The surface of the first gripping face can differ from the surface of the second gripping face. The sizes of the gripping faces can be different with one face being larger than the other if desired. At least one of the gripping faces can have one or more cut-out portions on the surface of the face to reduce the amount of material contact with the post.

This can assist in reducing slipping of the corner block along the post in use. At least one of the gripping faces can be modified with a material that increases the frictional adhesion with the surface of the post. The material that increases frictional adhesion can be increased surface roughness.

In order to attach the builder's line to the corner block, there can be notches in the body of the corner block for a tight interference fit of the line into the notch. The line can further be wrapped around the body of the corner block to further secure it to the block prior to securing the lose end in the notch. The string could be knotted at one end to prevent it from being pulled out of the notch. In order for the attachment of the line to the block to be convenient it can be useful if the body of the corner block extends away a short distance from the post. This can allow for manipulation of the string while the block is located on the post. The corner block can therefore have a body that is about 1, 2 or 3 cm extending away from the post as measured from the post. The extension of the body can be provided by the wall of the reinforcing fin. There can be notches in each of the reinforcing fins provided. The notches can align in use to provide a passageway along which the string can be passed. The notches can be indentations in the edges of the fin. There can be more than one notch per fin. The edges of each notch can be rounded to help guide the string into the notch.

A magnet can be mounted in the body of the corner block. The magnet can be a standard magnet. The magnet can be a super magnet. The magnet can be a rare earth magnet such as a Neodymium magnet. Neodymium magnets have extraordinary strength even at their smallest size and are among the strongest permanent magnets in the world. The magnetic material of the super-strength magnets can be an alloy consisting of neodymium, iron, and boron (NdFeB). The magnet can have enough force to hold the corner block to the post. In some embodiments where the magnet is a super magnet it has additional force to hold the corner block in place even under applied pressure. The magnet can have a pull force of at least about 4, 4.5 or 5 kg. In an embodiment, the magnet has 4.3 kg of pull force.

The magnet can be associated with one of the pair of gripping faces. The magnet can be associated with both of the gripping faces in the pair. The magnet can be mounted in the surface of the gripping face of the corner block. However, if the magnet is located on the surface of the gripping face there is a risk that the magnet (particularly a super magnet) will be inadvertently dislodged from the housing and remain in place on the post when the corner block is removed. Accordingly, the magnet is optionally disposed underneath the surface of the gripping face so that it does not contact the post, but still its magnetic forces are sufficient to be attracted to the post. In this embodiment, when the corner block is pulled away from the post, the magnet is pulled away with the corner block. In order to be mounted underneath the surface of the gripping face, the magnet can be housed in a cavity formed in the body of the corner block. The cavity can have an opening that allows for insertion of the magnet. The opening can remain open after the magnet has been inserted. The opening can be sealed after insertion of the magnet so that the magnet cannot be seen and cannot be removed.

The magnet can be a solid magnet added to the corner block. The magnet can be mixed into the plastic or rubber used to form the corner block for example a magnetic dust/shavings additive. Where the magnet is mixed into the plastic, it should be understood that the magnet is mounted in the body by being dispersed in the body. Where the magnet is at least one solid piece, each magnet can comprise more than one magnet part. Each corner block can comprise one or more magnets. In an embodiment, each corner block comprises at least two magnets.

Each magnet can be arranged in its own housing. A first magnet can be arranged in a first housing arranged behind the first gripping face. A second magnet can be arranged in a second housing also arranged behind the first gripping face but spaced from the first magnet. Where the gripping member is formed by the arms of a cross, the housing can be formed by providing a shelf under one of the arms of the cross. The shelf can be formed from the same material as the corner body. The magnet can be slipped onto the shelf and then the opening to the shelf can be sealed.

In use, the builder will select the appropriate first corner block for use (according to the shape of the posts located on site). The builder can then measure using known techniques where the corner block should be located on the post. A mark can be made at the location at which the corner block should be located. The corner block can be brought towards the post. The magnet(s) in the corner block can engage with the post strongly connecting the corner block to the post. The corner block can be moved upwardly or downwardly to ensure that it sits where the mark was made for its location. Once in position, a second corner block can be applied in the same way on a different post remote from the first post. The line can be attached to the first corner block before it is installed on the post. The line can be installed afterwards, but this is more awkward since the line can be wrapped around the block body. The corner block can be attached to the profile/post/straight edge. To install the second corner block, the builder (installer) walks to the other post at the other corner and estimates where to attach the line to the other corner block which will be a distance short from the corner so that the line can be tensioned when pulled. The corner block is pulled tight to give the stringline tension. The second corner block is then placed/magnetized on to the post.

BRIEF DESCRIPTION OF THE FIGURES

Embodiments of the present disclosure will now be described with reference to the accompanying drawings which are not drawn to scale and which are exemplary only and in which.

DETAILED DESCRIPTION

Figure 1:
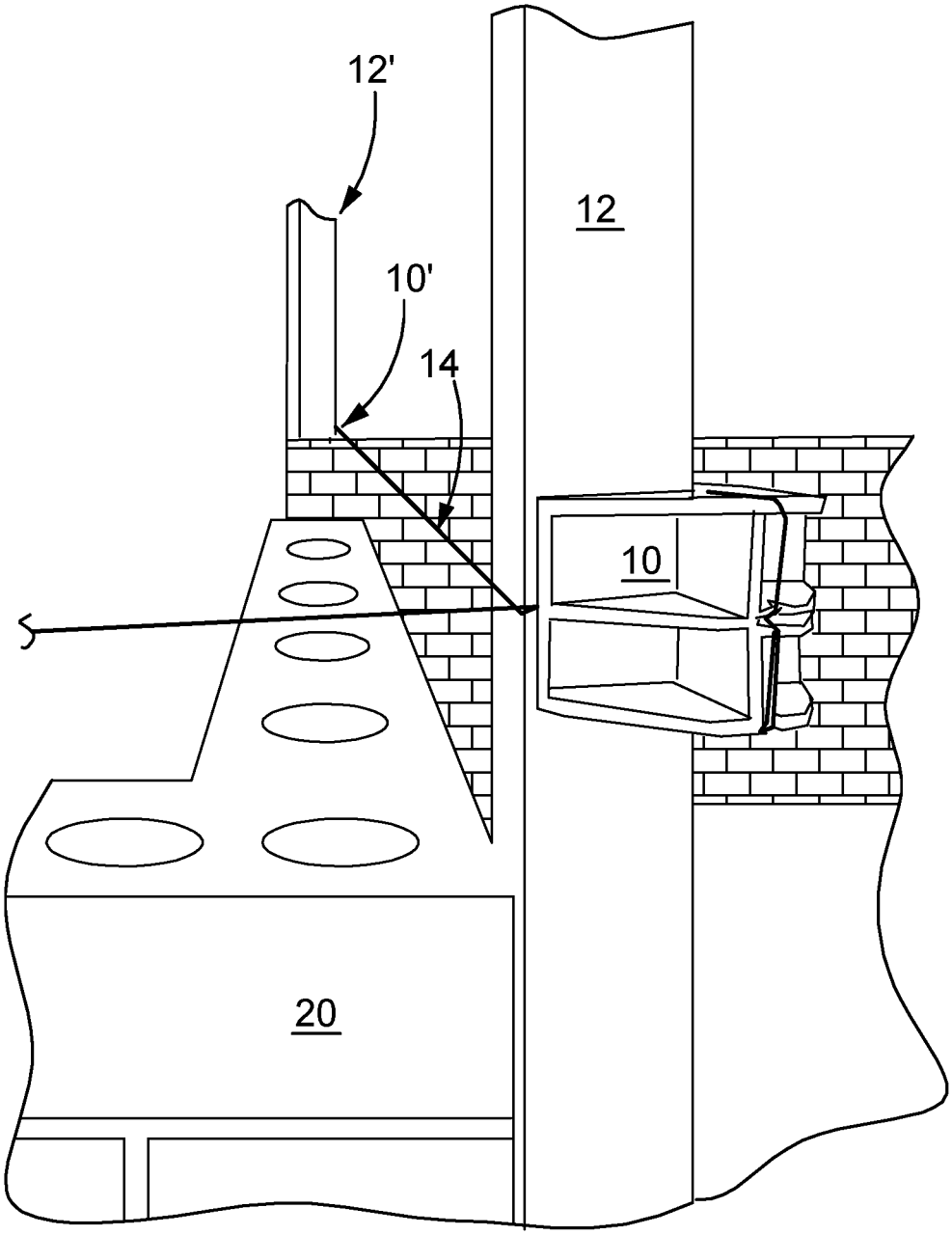
FIG. 1 is a background art corner block in position where the string extends between at least three posts (only two posts can be seen).
Figure 2:
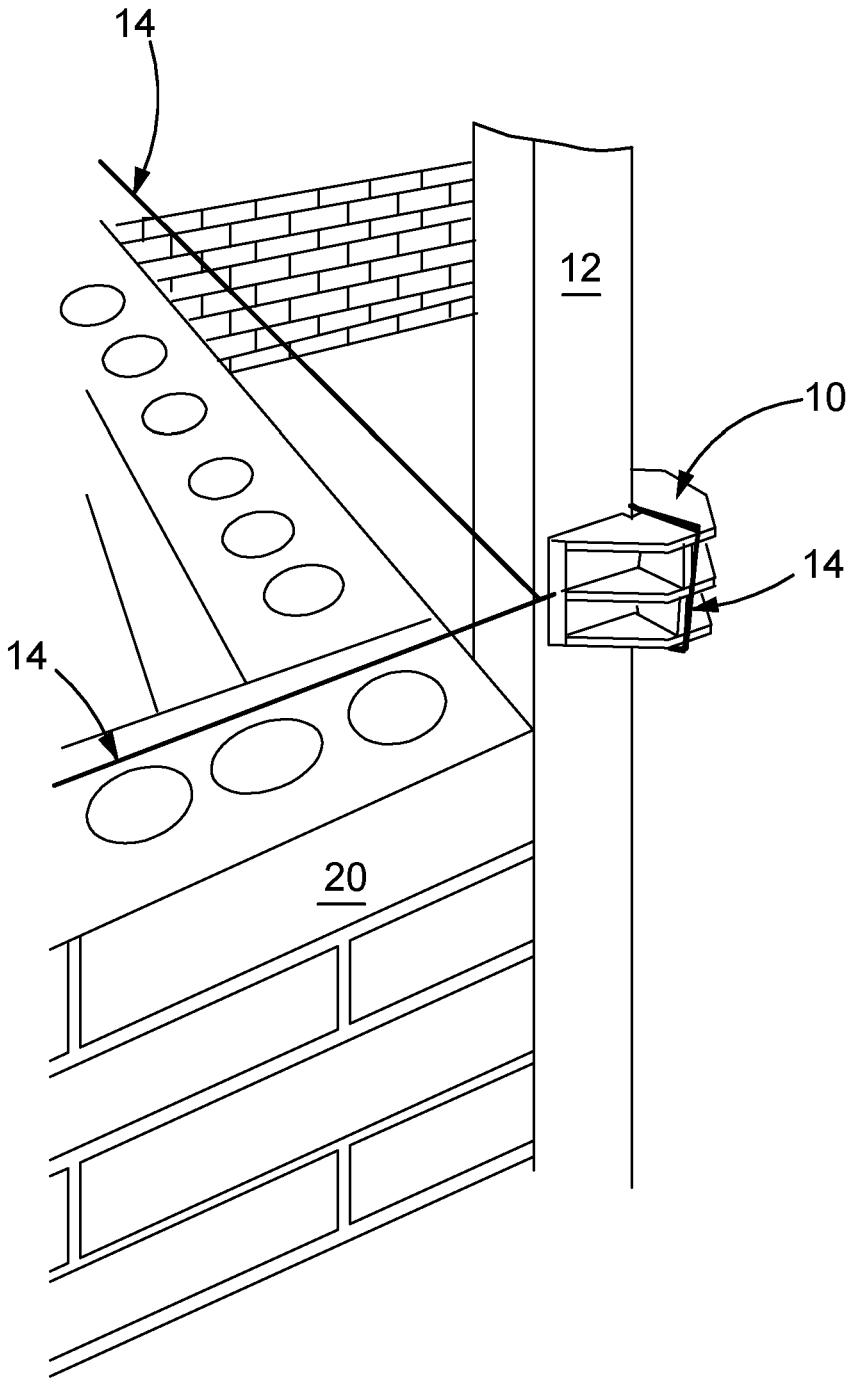
FIG. 2 is a different view of the corner block of FIG. 1.
Figure 3:
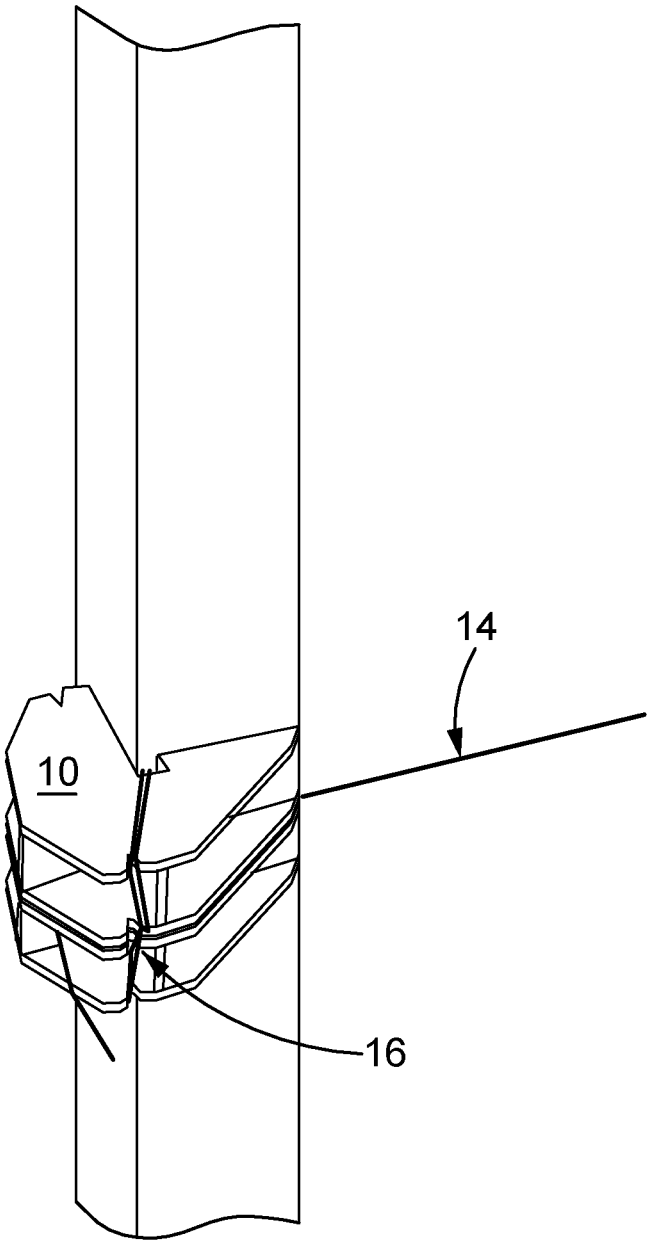
FIG. 3 is a background art corner block in position where the string terminates at that post.

In prior arrangements as shown in FIGS. 1 to 3, the string 14 of the builder's line 14 can be held taut between two corner blocks 10, 10' mounted at spaced apart locations. Corner blocks 10, 10' can provide a convenient means of securely attaching the string 14 into position. Each corner block 10, 10' can be mounted on a post 12, 12' at the required level for the building process. When laying bricks 20, for example, the builder's line 14 might be required at the upper level of the next layer of bricks. To hold the string 14 in place, the string 14 is wrapped as shown around a first corner block 10 including through notches in the block 10 which receive the string and hold it in place relative to the block body. The string 14 can then be pulled over to the other of the corner blocks 10' where it is similarly wrapped around the block's body 10' to hold it in place.

FIGS. 4 to 7 show a corner block 110 in accordance with an embodiment of the present disclosure. The corner block is made from polyurethane. A corner block 110 for supporting builder's line 114 (not shown) is mounted on post 112. In this embodiment, the body of the corner block 110 comprises two intersecting substantially flat pieces that together substantially form a cross (the cross is marked onto the Figure for illustration purposes). The cross is also shown for illustration purposes in side view in FIG. 8. Two arms of the cross A, B can form the gripping members 125 of the body of the block. The cross can be reinforced by one or more fins 120, 122, 124. In this embodiment, the cross is reinforced by a first reinforcing outer fin 120 which forms an outer surface of the corner block body 110. An intermediate reinforcing fin 124 is provided along the axis of the body 110. For additional reinforcement, the intermediate reinforcing fin comprises two layers 124, 124' with a space therebetween. A second reinforcing outer fin 122 is provided to form the opposing outer surface of the corner block body 110.

Figure 7:
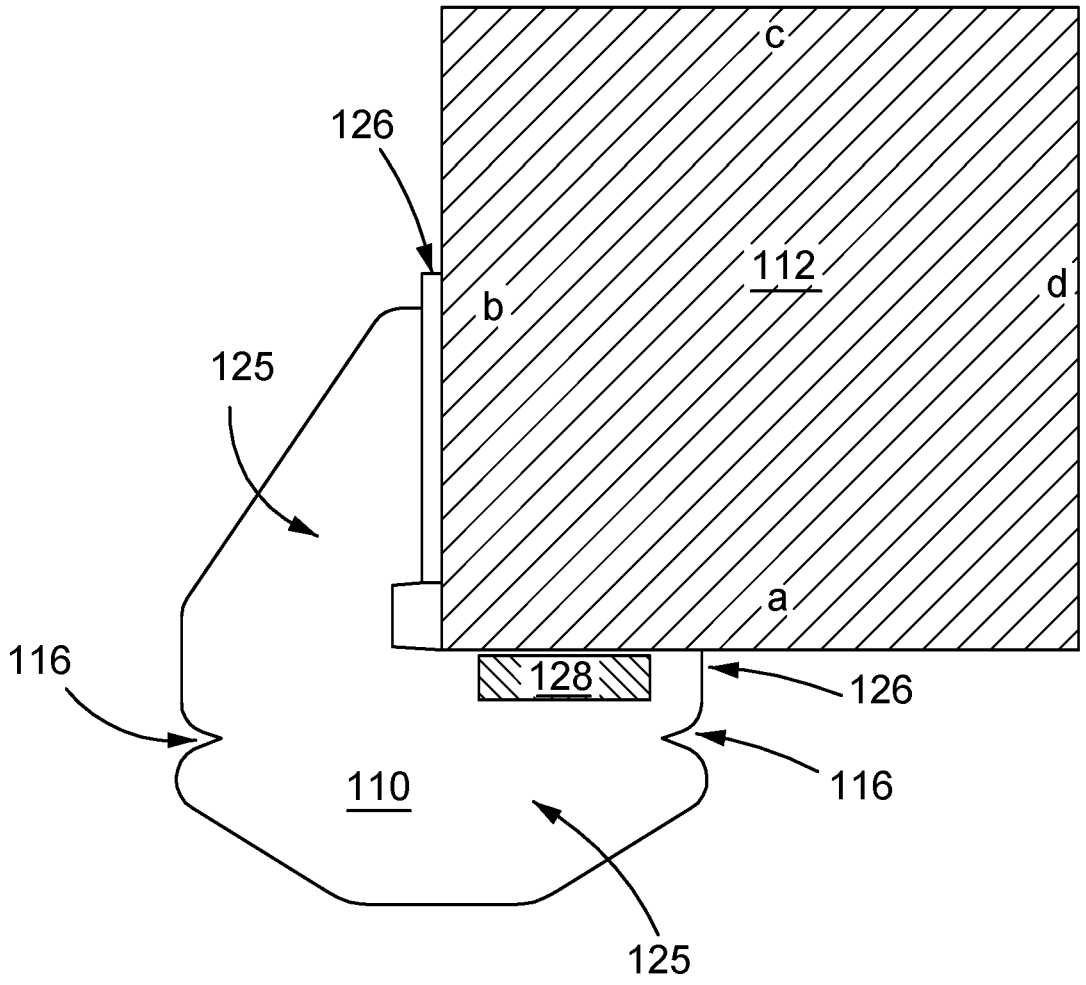
FIG. 7 is a side view of the corner block of FIG. 4.
Figure 8:
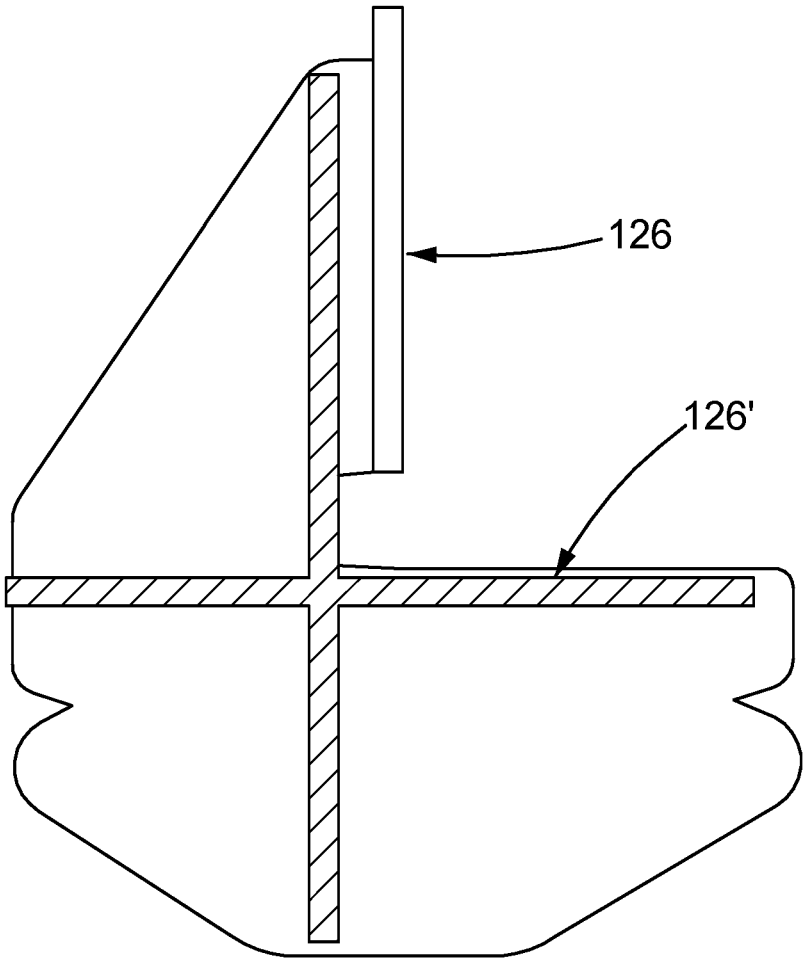
FIG. 8 is the same side view as FIG. 7, but the cross is shown in schematic for illustration purposes.

The gripping members 125, 125' are spaced apart from one another at 90 degrees, so, the corner block 110 has an L-shaped body. The gripping members 125, 125' can be brought towards the post 112 and then the gripping faces are applied onto the post surfaces. The gripping faces 126, 126' of the gripping members 125, 125' engage with two surfaces of the post. Where a post 112 has sides a, b, c and d, as shown in FIG. 7, the gripping faces 126, 126' can engage with surfaces a and b of the post 112. The surface of the first gripping face 126 can differ from the surface of the second gripping face 126' as can be seen in e.g. FIG. 6. The face 126 of gripping member 125 has cut-out portions on the surface to reduce the amount of material contact with the post 112. Gripping face 126' of gripping member 125' does not have this feature in this embodiment and instead it has a smooth flat face.

Figure 4:
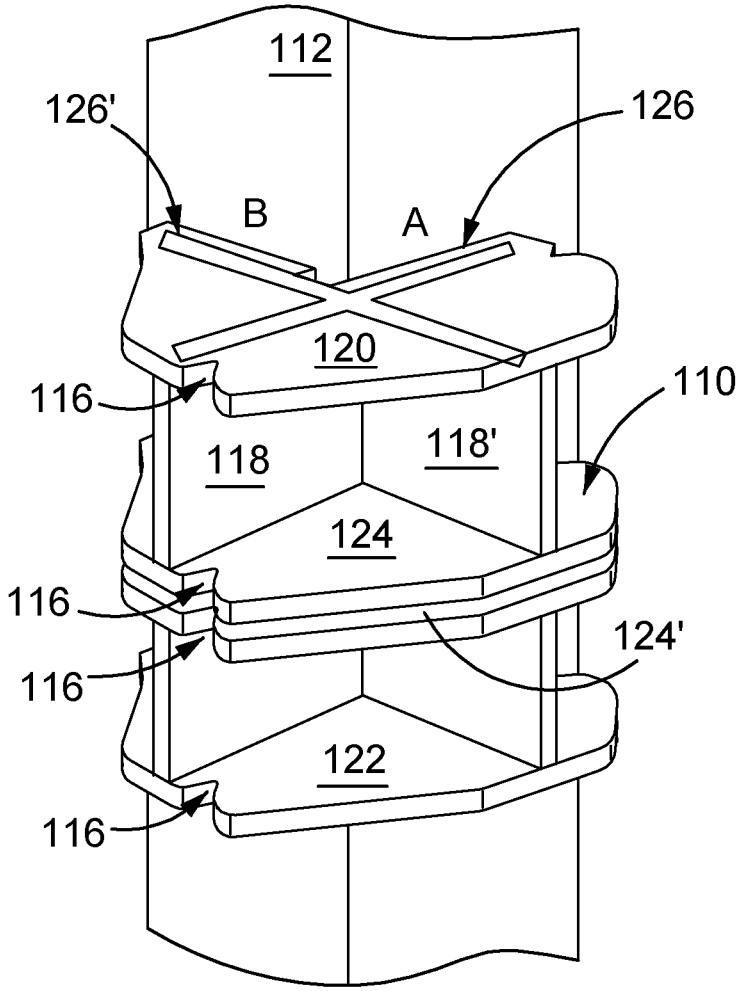
FIG. 4 is a perspective view of a corner block according to an embodiment of the present disclosure.
Figure 5:
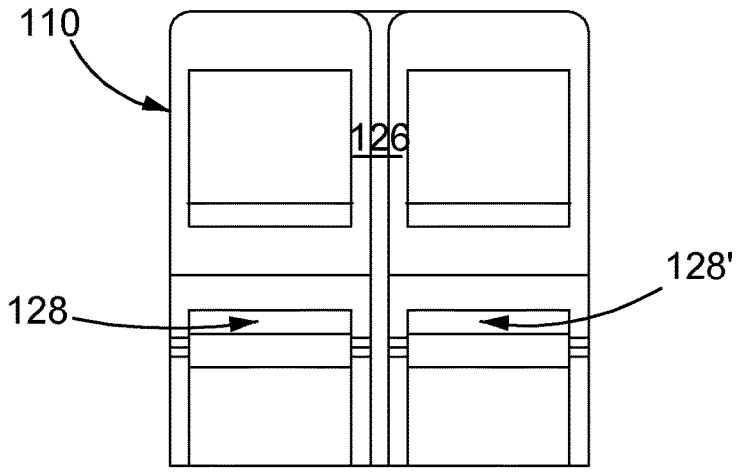
FIG. 5 is a front view of the corner block of FIG. 4.
Figure 6:
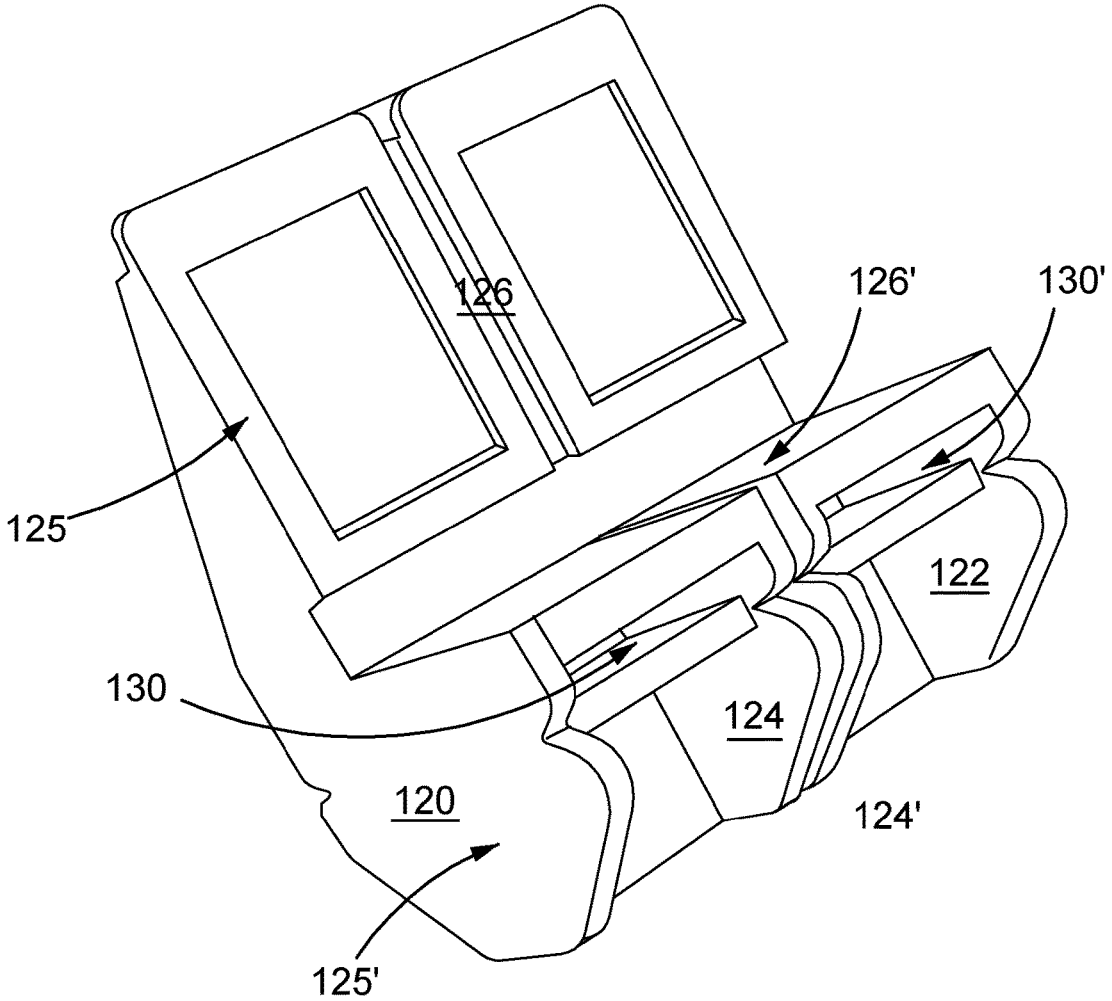
FIG. 6 is a perspective plan view of the corner block of FIG. 4.

In order to attach the builder's line to the corner block 110, there can be notches 116 in the body of the corner block for a tight interference fit of the line into each notch. The line can further be wrapped around the body 110 of the corner block to further secure it to the block prior to securing the lose end in the notch. There can be notches 116 in each of the reinforcing fins provided as shown in FIG. 4. The notches 116 can align in use to provide a passageway along which the string can be passed.

A magnet 128 is mounted in the body of the corner block 110. The magnet is a rare earth super magnet formed from neodymium, iron and boron (NdFeB). The magnet provides the corner block 110 with 4.3 kg of pull force. The corner block 110 has two magnets 128, 128'. Each magnet is in its own housing 130, 130'. A first magnet 128 is arranged in a first housing 130 arranged behind the first gripping face 126 in gripping member 125. A second magnet 128' is arranged in a second housing 130' behind the first gripping face 126 but spaced from the first magnet 128. The housing 130, 130' is formed by providing a shelf under the gripping face 126. Each magnet 128, 128' can be slipped onto the shelf and then the opening to the shelf can be sealed (not shown sealed). In FIG. 7, the housing for the magnet has been sealed.

Figure 9:
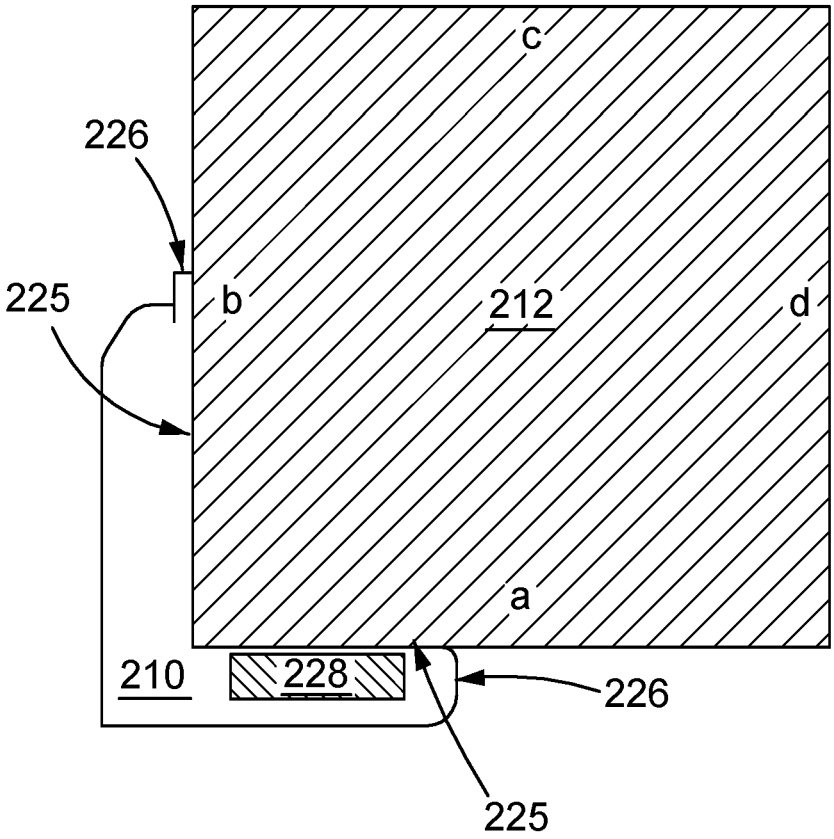
FIG. 9 is an embodiment of the corner block without the reinforcing fins.
Figure 10:
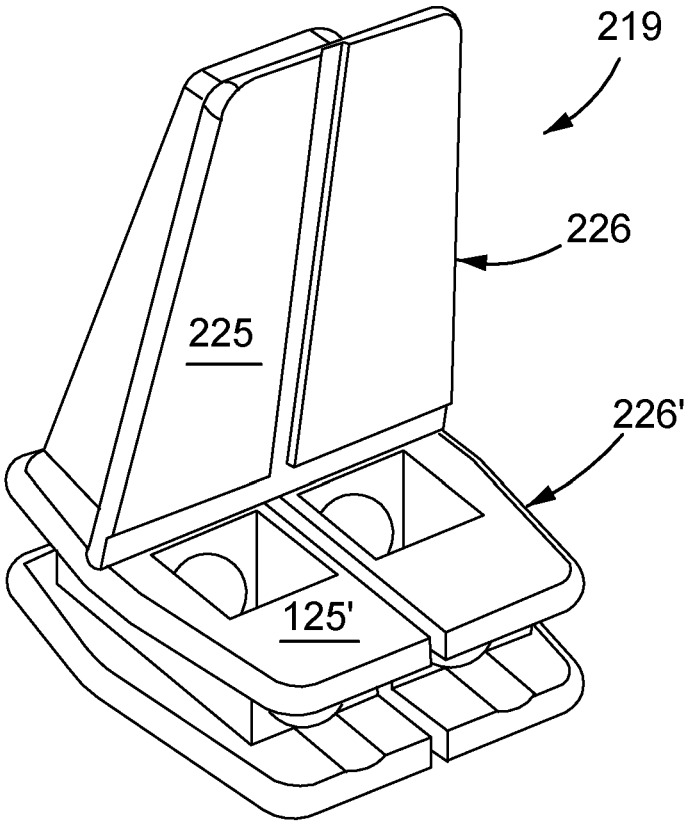
FIG. 10 is a perspective view of an alternative embodiment of a corner block.
Figure 11:
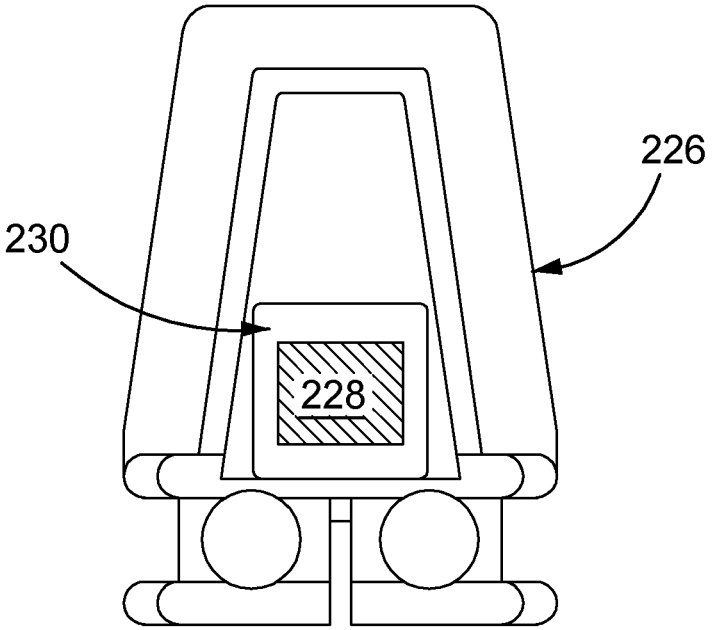
FIG. 11 is a rear view of the embodiment of FIG. 10.
Figure 12:
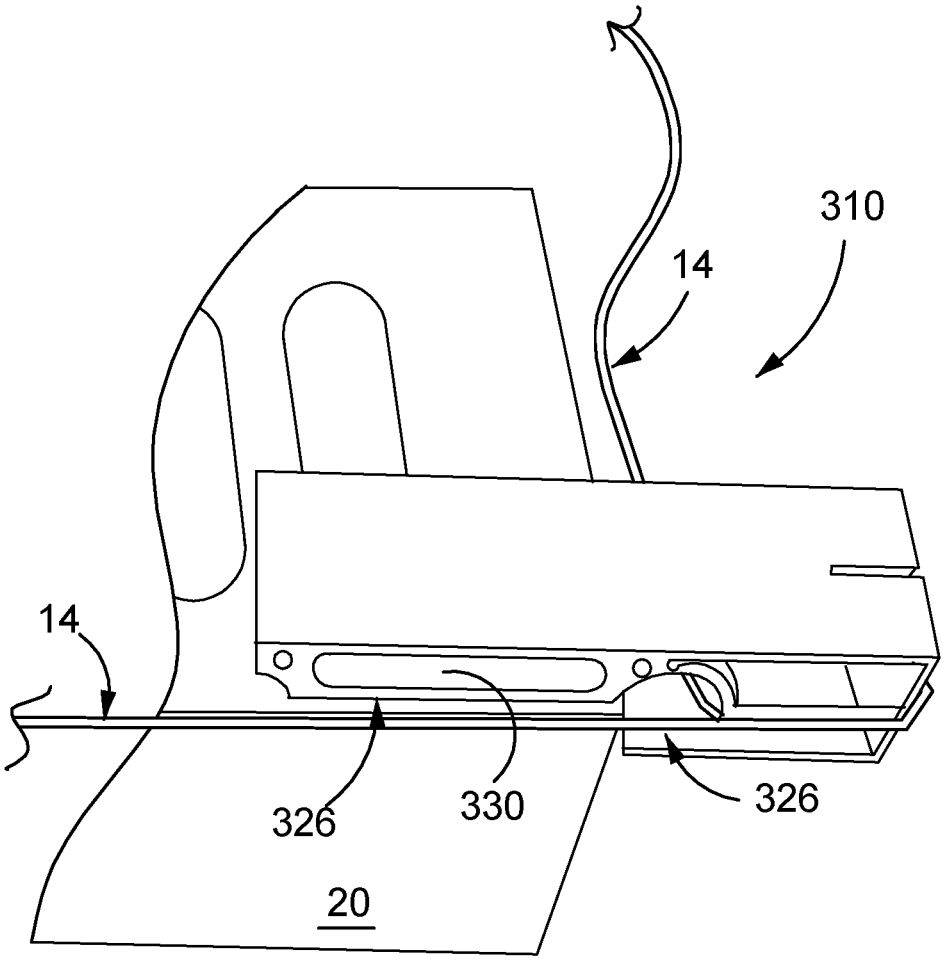
FIG. 12 is a perspective view of an alternative embodiment of a corner block.

FIG. 9 is an alternative embodiment of the corner block without the reinforcing fins. The body of the corner block 210 still houses the magnet 228 and the gripping members extend around post 212, but the fins are not provided. A perspective view of a block according to this embodiment is shown in FIG. 10 and a rear view in FIG. 11. The magnet 228 could be arranged as described in relation to the embodiment of described above. Alternatively, the magnet could be housed as shown in housing 230 which is a cut out defined in the back of gripping member 236. There can be a cover over the magnet 228 (not shown). An alternative embodiment is shown in FIG. 12. The corner block 310 of FIG. 12 has one very small gripping face 326', so the magnet is optionally located behind gripping face 326 in housing 330.

It is to be understood that, if any prior art publication is referred to herein, such reference does not constitute an admission that the publication forms a part of the common general knowledge in the art, in Australia or any other country.

In the claims which follow and in the preceding description of the disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the present disclosure.

Any promises made in the present description should be understood to relate to some embodiments of the present disclosure and are not intended to be promises made about the present disclosure as a whole. Where there are promises that are deemed to apply to all embodiments of the present disclosure, the applicant/patentee reserves the right to later delete them from the description and does not rely on these promises for the acceptance or subsequent grant of a patent in any country.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A corner block for supporting a-builder's line of a builder mounted between posts, the corner block comprising:

a body for receiving the builder's line in use;

a pair of gripping members, each gripping member having a gripping face engageable with surfaces of one of the posts in use; and at least one magnet mounted in the body so as to be associated with at least one of the pair of gripping faces, wherein the at least one magnet has a magnetic force sufficient to attract it to the material of the post to which the gripping faces are applied in use, wherein the at least one magnet is located behind the gripping face so that in use the gripping face is located between the at least one magnet and the post.

2. The corner block according to claim 1, wherein the at least one magnet has a pull force of at least about 4 kg.

3. The corner block according to claim 2, wherein the at least one magnet is a super magnet.

4. The corner block according to claim 3, wherein the at least one magnet is a rare earth magnet or a Neodymium magnet.

5. The corner block according to claim 1, wherein the at least one magnet is associated with both of the pair of gripping faces.

6. The corner block according to claim 1, wherein the at least one magnet is associated with only one of the gripping faces in the pair.

7. The corner block according to claim 1, wherein the pair of gripping faces comprises a first gripping face and a second gripping face, and wherein a first magnet is arranged in a first housing arranged behind the first gripping face and a second magnet spaced from the first magnet is arranged in a second housing also arranged behind the first gripping face.

8. The corner block according to claim 1, wherein the body of the corner block comprises two intersecting substantially flat pieces of material forming a cross.

9. The corner block according to claim 8, wherein two arms of the cross form the gripping members of the body.

10. The corner block according to claim 9, wherein the mounting for the at least one magnet in the body is formed by a shelf arranged under one of the arms of the cross.

11. The corner block according to claim 10, wherein the at least one magnet is sealed into the body of the corner block.

12. The corner block according to claim 8, wherein the cross is reinforced by one or more fins.

13. The corner block according to claim 12, wherein the fins comprise at least a first reinforcing outer fin which forms an outer surface of the corner block body and a second reinforcing outer fin which forms the opposing outer surface of the corner block body.

14. The corner block according to claim 13, wherein an intermediate reinforcing fin is provided along the axis of the body intermediate the first outer fin and the second outer fin.

15. The corner block according to claim 1, wherein the gripping members are spaced at 90 degrees so the corner block has an L-shaped body.

16. The corner block according to claim 1, wherein the pair of gripping faces comprises a first gripping face and a second gripping face and wherein the surface of the first gripping face differs from the surface of the second gripping face.

17. The corner block according to claim 1, wherein at least one of the gripping faces can have a cut-out portion on the surface of the face to reduce the amount of material contact with the post.

18. The corner block according to claim 1, wherein there are notches in the body of the corner block for a tight interference fit of the line into the notch.

19. A method comprising using the corner block according to claim 1 to mount a line of a builder between a pair of posts.

20. A corner block for supporting a builder line mounted between posts, the corner block comprising:

a body for receiving the builder line in use;

a pair of gripping members disposed at an angle relative to one another, wherein a first gripping member in the pair forms an angular surface and a second gripping member in the pair forms a back of the angular surface, each gripping member having a gripping face engageable with surfaces of one of the posts in use; and at least one magnet mounted in the body so as to be associated with the gripping face of the angular surface, wherein the at least one magnet has a magnetic force sufficient to attract it to the material of the post to which the gripping faces are applied in use, wherein, the gripping member that forms the angular surface has a narrowed body portion below the angular surface, the narrowed body portion being at least one part of the corner block that can receive and hold the builders line in use.

* * * * *